United States Patent [19]

DiRusso, Jr. et al.

[11] Patent Number: 4,813,206

[45] Date of Patent: Mar. 21, 1989

[54] TAPE SEALING THE PERIMETERS OF CARTON WALLS

[75] Inventors: Anthony DiRusso, Jr., North Bellmore; Joseph S. Lerner; David Krukas, both of Kings Park, all of N.Y.

[73] Assignee: The Loveshaw Corporation, Ronkonkoma, N.Y.

[21] Appl. No.: 90,001

[22] Filed: Aug. 27, 1987

[51] Int. Cl.[4] ..... B65B 51/06; B65B 61/00

[52] U.S. Cl. ..... 53/137; 53/139.3; 53/580

[58] Field of Search ..... 53/374, 137, 139.3, 53/590, 491, 580

[56] References Cited

U.S. PATENT DOCUMENTS

| | | | |
|---|---|---|---|
| 3,491,657 | 1/1970 | Feigel | 53/137 X |
| 3,561,190 | 2/1971 | Derenthal | 53/137 X |
| 4,044,527 | 8/1977 | Ulrich et al. | 53/137 |
| 4,543,150 | 9/1985 | Marchetti | 53/137 X |
| 4,554,042 | 11/1985 | Marchetti | 53/137 X |
| 4,572,760 | 2/1986 | Marchetti | 53/137 X |
| 4,585,504 | 4/1986 | Marchetti | 53/137 X |
| 4,633,642 | 1/1987 | Lissoni | 53/137 |
| 4,732,644 | 3/1988 | Chiu | 53/137 X |

*Primary Examiner*—Horace M. Culver

*Attorney, Agent, or Firm*—George J. Brandt, Jr.

[57] ABSTRACT

Perimeter seals are applied to cartons to seal them in courses which encircle a carton wall at which the transverse edges of infolded carton closure flaps are disposed. Such perimeter seals create a seal of the carton interior to prevent access thereto by dust in the atmosphere, moisture, etc. Apparatus for applying the seals includes devices to apply tape around the carton wall and wipe that applied tape onto perimeter areas of the encircled wall as well as marginal areas of the four walls adjacent and orthogonal thereto.

35 Claims, 13 Drawing Sheets

TAPE SEALING THE PERIMETERS OF CARTON WALLS

BACKGROUND OF THE INVENTION

The most common mode of tape sealing rectangular shipping cartons involves applying tape runs along the top and bottoms thereof to overlap and thereby secure infolded flap members with the tape runs, the tape runs having anchoring run segments which are adhered on the opposite carton end walls between which the carton top and bottom wall defining infolded flaps extend. With the advent of pressure sensitive face sealing tape and more efficient tape sealing machines, there has been achieved a high degree of reliability in effective and secure sealing of these cartons and the two longitudinal upper and lower tape courses applied to cartons of this type are sufficient to provide carton sealed structure integrity and protection for the contained contents. This practice does not of course environmentally seal the carton, i.e., isolate the carton interior and contents from ambient conditions since the transverse ends of the infolded flaps of the carton top and bottom have unsealed lengths which constitute access locations by which ambient matter such as dust, moisture and the like could be communicated to the carton interior. In those instances where sealing of the interior from ambient surroundings to provide protection of a given contained product from adverse ambient factors is required, it is known to additionally apply sealing tape around the carton perimeter where infolded flaps adjoin an adjacent orthogonally disposed wall. These perimeter seals which can, e.g., either fully or only partly encircle each of an opposed pair of walls of the carton and are crosswise to the infolded flap seals are frequently referred to in the art as "H-seals". As far as we are aware, application of these seals to cartons heretofore has been done manually or where machine taping is practiced, such machine taping requires either that the box have a stopped position during performance of certain of the machine taping operations or if the taping be done while the carton is moving, it be done in a sequence of taping steps and with devices which result in unsightly taping due to failure to properly adhere all the tape to carton surfaces as well as the likelihood of wrinkling of the tape, particularly the tape disposed at the top and bottom of a carton. These shortcomings and especially tape wrinkling are very evident in instances where heavily adhesive coated tape such as a duct tape is used. The wrinkling of tape will occur because vertically oriented tape will be wiped against a carton side wall, followed by wiping of horizontally oriented tape against such side wall. With that sequence of wiping steps, the devices which are employed to effect wiping of the vertically oriented tape generally will contact at least part of the horizontally oriented tape and wipe it in a direction 90° displaced from that at which wiping action should be applied to that horizontal tape. If it b sought to avoid wrinkling of the horizontal tape by using a shorter length of tape wiping member to wipe the vertical tape against the carton wall so as to thereby avoid interference of that member with the horizontal tape which (and the vertical tape as well) will be bowed inwardly of the carton wall periphery due to tension in the tape, there will of necessity be some part of the vertical tape length which is not contacted by that member for optimized wiping of that tape length put against the carton wall. Further that sequence of tape wiping will produce a condition of non-adhesive face-to-non-adhesive face folding of the terminal ends of adjacent vertically and horizontally disposed tape lengths that will result in only partial adhesion of the terminal ends to the carton wall and a wrinkled unsightly appearance at those ends. Even if a proper fold of the terminal ends of the adjacent vertically and horizontally disposed tape lengths could be achieved, it would be with a result that the fold would not lie sufficiently flat against the carton wall as to not be a possible peel point for inadvertent or accidental peel-off of some of the applied tape in the H-seal.

SUMMARY OF THE INVENTION

An object of the present invention is to provide a method and machine for applying tape in sealing courses around perimeter edges of rectangular shipping cartons.

Another object is to provide a method and machine which applies such tape sealing courses to a carton as it is continuously advanced in a forward travel course in a manner as effects a secure and neat wiping of tape against a carton side wall and the four walls adjacent thereto and based on the use of a particular and novel sequence of tape folding manipulations.

Other objects of the invention will be made apparent from the description of the invention set forth below.

The present invention relates to applying perimeter edge seals to rectangular shipping cartons. As used herein a "perimeter edge seal" is to be understood as meaning a tape course of encircling character (either fully or partly) which wraps around lengthwise of a rectangular configured carton side wall with the tape of such course being adhered to marginal areas of the four carton walls (i.e., top, bottom and opposed end walls) which are disposed adjacent and orthogonally to the said side wall and also being adhered to perimeter areas of that side wall. Also it will be understood that "side wall" as used herein is intended to mean that upright wall of a rectangular shipping carton which is disposed transverse to the ends of the infolded flaps which define carton top and bottom wall structure It also will be understood that preliminary to tape sealing of a perimeter edge seal on the carton it will have been tape sealed along the top and bottom infolded flap seams of such carton in conventional manner.

In accordance with the invention, the carton to which a perimeter edge seal is to be applied is continuously advanced forwardly endwise along a straight line travel course axis. "Endwise" means that the carton side walls will move in travel paths parallel to the travel course axis so that the prior taped infolded flap seams are crosswise to that axis. The carton forward advance can be effected with upper and lower carton engaging conveyor belts arranged to engage the carton top and bottom walls in central regions only so that the side wall and marginal areas of the top, bottom and two end walls are unobstructed as ensuring taping operations will involve engagement of these parts of the carton with taping devices. This is a distinctively different requirement than is involved with sealing of infolded flap seams wherein the tape is applied only along the central region of the carton and hence the side portions could be engaged by carton forward advance and/or travel guidance means.

In moving forwardly along its travel path, the carton will encounter upper and lower taping cartridges which each include tape applying members, a stock of pressure sensitive tape and a tape cutter. The tape applying members in each cartridge and which normally project into the carton travel course will be engaged by the advancing carton and thereby initiate application of tape (drawn from the tape stocks) to the carton, the tape applying members moving to retracted position as they continue to apply tape to the carton, this tape application being completed as the carton passes forwardly of the tape applying members and the same return to projecting position, the tape cutter of each cartridge functioning to sever the tape length applied to the carton from its stock. This type of taping cartridge is disclosed, e.g., in commonly owned U.S. Pat. Nos. 4,039,367 and 4,640,731. The upper cartridge applies tape in a run from the carton forward end wall, onto the top wall and down into the trailing end wall. The lower cartridge applies a separate tape run from the forward end wall, onto the bottom wall and up onto the trailing end wall.

The invention provides that these taping cartridges are disposed relative to the carton travel course, and more particularly the path along which the carton side wall moves, such that a first width portion only of the applied tape runs is adhered to marginal areas of the carton forward end, top and bottom and trailing end walls, i.e., such first width portion is adhered to such walls in the areas immediately adjacent the side wall. Thus a second width portion of the applied tape runs extends laterally sideways from each of the forward end, top and bottom and trailing end walls beyond the carton side wall.

The upper and lower cartridges conveniently, but not essentially, are longitudinally spaced along the carton travel path so that one will apply its tape run to the carton before the other. Also the cartridges can be vertically spaced one from the other in such manners that the tape runs applied therewith and which dispose lengthwise of the carton sidewall, are of only partly encircling character wherein the terminal ends of the runs on the respective forward and trailing end walls are spaced, or that these runs may be fully encircling in the sense that the terminal ends of such runs are overlapped one with another.

A tape wiping station is located downstream of the taping cartridges and upper and lower tape wiping plates are mounted at that station alongside the carton travel path adjacent the movement path of the carton side wall. These plates each have two longitudinally spaced nesting positions and can be operated between said nesting positions by a power means for the purpose of wiping the tape extending laterally from the carton top and bottom walls against upper an lower perimeter areas of the carton side wall to adhere it to said areas. An important feature of the invention is that the wiping of the tape extending sideways from the carton top and bottom walls is wiped against the carton side wall before that extending sideways from the forward and trailing end walls is wiped against the side wall. The movement of the tape wiping plates will be cyclic for each carton passing through the wiping station, i.e., the plates will be stroked forwardly from one nesting position to the other to effect wiping at the fore end length of the carton side wall upper and lower perimeter areas and then stroked rearwardly from the said other to the said one nesting position to effect wiping at the after ends of the carton side wall upper and lower perimeter areas. In furtherance of this tape wiping by the plates, a carton actuated switch member is used to control application to the power means, the engagement of the front end of the carton retracting the switch to control plate forward stroking and its release from retracted position by carton pass by controlling the rearward stroking.

As noted in the prior paragraph, a feature of the invention is that when the tape wiping plates move forwardly and rearwardly this movement in addition to wiping the tape laterally extending from the carton top and bottom walls onto the carton side wall, will fold the tape laterally extending from the carton forward and trailing end walls in respective forwardly and rearwardly arrayed disposition parallel to the side wall. In so folding such tape there are formed oblique adhesive face-to-adhesive face folds therein adjacent the carton top and bottom walls, i.e., where the ends of the horizontally oriented and vertically oriented sideways extending tape lengths meet, so that when such respective forwardly and rearwardly facing or arrayed tape lengths are subsequently wiped through a 180 degree course to adhere them to the carton side wall these oblique folds will face inwardly of the carton side wall thereby lessening the likelihood that such oblique folds can serve as tape peel-off initiation points which is a condition more likely to occur if the folds faced in outward directions.

To effect the wiping of the tape which was laterally extending from the carton forward and trailing end walls (and which was folded to the respective forwardly and rearwardly facing parallel-to-the carton side wall disposition) against perimeter areas of the carton side wall, first and second tape pressing members are located downstream of the wiping station. The first tape pressing member is a movably mounted tape presser carried on a pivoted arm which arm is normally biased to extend said tape presser to a position wherein it will be engaged by the forward end wall of the advancing carton proximal the taped marginal area thereof. The carton advance will pivot the carrier arm in the forward direction counter to the bias and during that movement, the first tape presser will move from its point of first engagement with the carton forward end wall outwardly along said forward end wall and will pass onto the carton side wall around the vertical corner defined by the carton forward end and side walls to a carton advance cleared position. In so moving it will wipe the tape extending from the forward end wall onto the forward perimeter area of the carton side wall to adhere it to said area and further carry the oblique folds adjacent the carton top and bottom walls into rearwardly facing position. The first tape presser carrier arm will be maintained in displaced position until after the carton trailing end wall has passed beyond it at which time the bias on the carrier arm will move it rearwardly to the position wherein it will present the first tape presser in a position to engage the forward end wall of the next carton to be taped in the machine.

A second tape presser is also disposed downstream of the tape wiping station and is employed to effect wiping of the tape extending from the trailing end wall of the carton onto a perimeter area of the side wall. This second tape presser is carried on a movable mounting frame, the frame having a normally idle position wherein it positions the second tape presser outside the carton travel course. The mounting frame includes a pivoted rigid section and a foldable section pivoted to the rigid section with the second tape presser being carried on an end of the foldable section. Normally a bias means connected to the rigid section and to the foldable section acts on these sections to maintain them longitudinally aligned one with the other. A power stroking means is connected to the rigid section of the mounting frame. A carton actuated control element is disposed in the path of carton travel to control operation of the stroking means. This control element is positioned downstream of the stroking means location so that when the carton forward end wall strikes and depresses same, it will be moved to a position wherein power is communicated to the stroking means to drive it in a direction in which it strokes the mounting frame forwardly from behind the advancing carton to engage the second tape presser against the carton trailing end wall proximal the taped marginal area thereof. Since the stroking means operates to stroke the mounting frame forwardly at a speed greater than that at which the carton is advancing, the foldable frame section of the frame member will be caused as the second tape presser strikes the carton trailing end wall to fold relative to the rigid section so that the said tape presser will be carried outwardly on the carton trailing end wall and will pass around onto the carton side wall and in so doing, wipe the tape extending from the carton trailing end wall onto a trailing perimeter area of the carton side wall to adhere it to said area. After the carton trailing end wall has passed beyond the control element, such element is released and power is thereby communicated to the stroking means to stroke the mounting frame rearwardly and back to an idle position.

The invention further provides that the tape wiping component of both the first and second presser means can be for each a special roller assembly which is carried on its associated carrier or mounting arm so as to have limited pivoting movement to allow the rollers in the assembly to closely conformably engage with irregular or skewed carton wall surfaces.

The invention accordingly comprises the features of construction, combination of elements, arrangement of parts and taping steps as will be exemplified in the carton perimeter taping method and machine therefor hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Throughout the following description, like reference numerals are used to denote like parts in the drawings.

DESCRIPTION OF THE PREFERRED EMBODIMENTS

Figure 1:
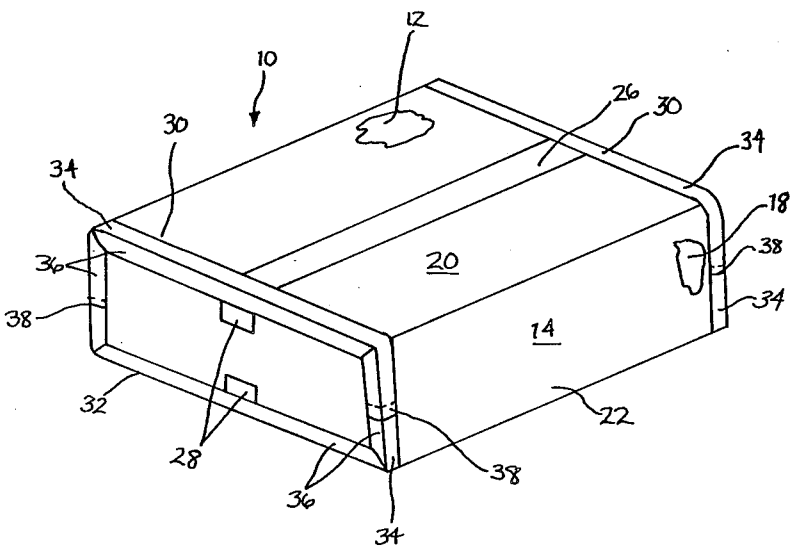
FIG. 1 is a perspective view of a rectangular shipping carton which has been sealed with perimeter seals extending around opposite side walls thereof, the carton additionally having been tape sealed along the top and bottom infolded flap seams in known manner prior to application of the perimeter seals.

FIG. 1 shows a rectangular shipping carton 10 to which has been applied perimeter tape seals at both sides thereof and it also has an infolded flap tape seals extending along the seams defined by confronting inwardly located edges of infolded flaps which define the carton top and bottom walls. It will be understood that while in most instances, two perimeter seals will be applied to a carton, there can be instances where only one need by applied. For example, the shipping carton may be a preformed type having only one open side which is closed off by infolded flaps and thus will require application of a perimeter seal around only one wall location.

Referring to FIG. 1, carton 10 has a forward end wall 12, a rear or trailing end wall 14, a side wall 16, an opposite side wall 18, a top wall 20 and a bottom wall 22. The top and bottom wall structure is defined by foldable flaps infolded and sealed along a seam defined by the confronting edges of the infolded flaps, this being illustrated in FIG. 2 wherein the confronting edges 24*a* and 24*b* of carton top wall flaps are shown and the sealing tape which seals this seam being illustrated at 26, the sealing tape running onto the carton side walls for anchoring purposes and as shown at 28 in that Figure, these flap seam seals being applied to the carton preliminarily in known manner. With the flap seams sealed on carton 10, the transverse end edges of the top and bottom wall flaps will extend along the top and bottom of the carton side walls but the disposition is such that access to the carton interior of ambient environment substance presence is possible. The ambient environment can and in most instances will be the normal atmosphere. But that environment may be dust-laden or highly humid or it may include certain matter inimical to the carton contents. It is to seal off these access courses that perimeter seals are applied. Such seal as applied around carton side wall 16 is comprised of an upper encircling tape run 30 and a lower tape run 32. These tape runs are applied in a manner that a first lateral or width portion 40 of each becomes adhered to marginal areas of the forward end wall 12, the top and bottom walls 20, 22 and the trailing end wall 14, as at 34, "marginal area" meaning an area of each of such walls which is immediately adjacent the orthogonally disposed side wall 16. This first tape width can, e.g., be approximately one inch. The remaining width portion of the tape runs (which also could by way of example, be one inch) is folded around the corners defined by such walls and the carton side wall 16 onto perimeter areas of the side wall 16 to adhere it to such areas as at 36. The tape runs 30, 32 can be applied to the carton so that they overlap one with the other on the end walls as shown generally at 38 to provide a fully encircling course around the side wall. This is not essential though since in a given instance the tape courses could be terminated on the carton end walls and side wall with a spacing between the terminal ends of each run. The adherence of the first width portions of the tape runs 30, 32 to the marginal areas of walls 12, 20, 22 and 14 produces a tension in that first width portion so that the second width portion which extends sideways of the carton side wall as will be described shortly, bows or sags and lies somewhat limply inwardly of the periphery of the carton sidewall.

Figure 2:
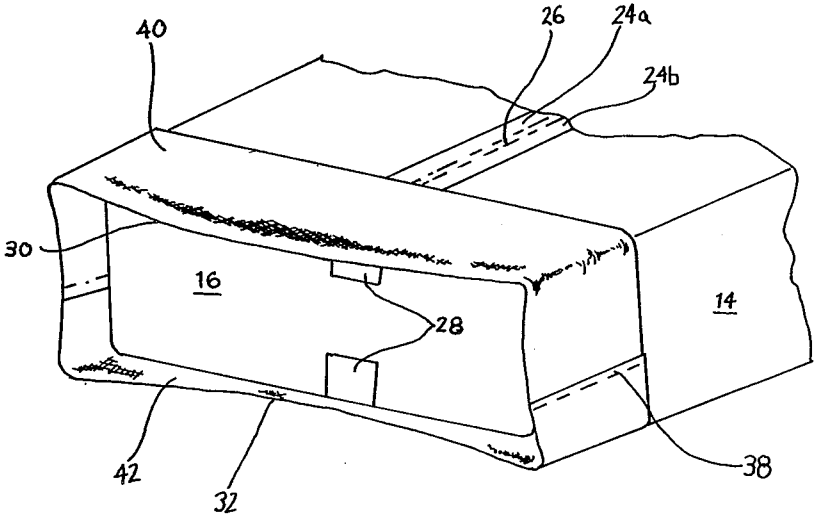
FIG. 2 is a fragmentary perspective view of a side portion of the carton shown in FIG. 1 following the application of tape runs at the top and bottom thereof and in an encircling course about the carton side wall, a first lateral width portion only of the applied tape being adhered to the carton top, bottom and opposed end walls at marginal areas of each, the remaining lateral width portion of the tape extending laterally sideways beyond the carton side wall, the tape in the sideways extending portion being bowed inwardly of the carton sidewall periphery due to the tension present in the first lateral portion which is adhered to the four walls.

When the tape runs 30, 32 are to be applied to the carton, it can be done with tape applying members that are longitudinally aligned and operate in taping paths that are laterally coincident. Further they can be arranged such that those associated with applying one tape run will have longer taping arms than the members used for applying the other tape run so as to provide the terminal end overlap as at 38 (FIG. 2). Overlap also can be achieved with cartridges having arms of the same lengths, but such length that it will tape on a carton end wall for a distance more than half the carton height. Also, this overlap need not be present since the ends of the two runs can be spaced apart on the carton end walls. When adhered to the carton top, bottom and end walls in an encircling or partly encircling course thereabout, there will before wiping of tape onto the side walls, be lateral sideways extension of the tape second width portion 42 beyond the carton side walls as illustrated in FIG. 2 and which extending tape will sag or bow as shown. This tape application will be effected while the carton is being forwardly advanced along a straight line travel path and the subsequent wiping operations to adhere the tape onto the carton side walls will also occur while the carton is being advanced forwardly. The sequence of these wiping operations will be described next and with reference to FIGS. 3*a* through 6*b*.

Figure 3A:
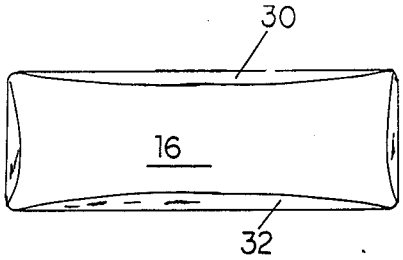
FIG. 3*a* is a side elevational view of the carton shown in FIG. 2
Figure 4A:
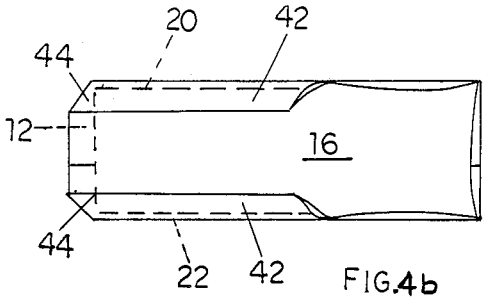
FIGS. 4*a* through 6*b* are a depiction of the tape wiping step sequence by which the tape extending sideways beyond the carton side wall is folded to adhere it to perimeter areas of the carton side wall, such tape adherence being effected with wiping plates and wiping rollers, the said Figures designated a being side elevational views and those designated b being top plan views and each being associated with the a Figure of the like numeral.
Figure 3B:
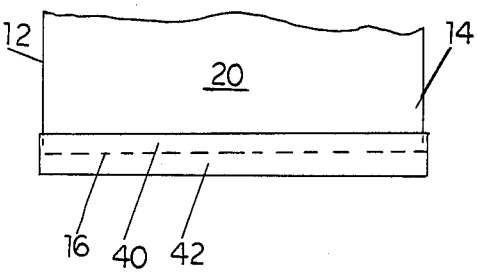
FIG. 3*b* is a top plan view of FIG. 3*a;*
Figure 4B:
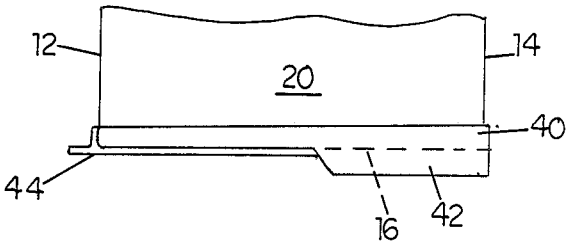

As seen from FIGS. 3*a* and 3*b*, the application of tape runs 30, 32 result in adhesion of the pressure sensitive tape to the carton in the tape first width portion 40 thereof, and the second width portion 42 extends beyond the carton side wall 15. The first wiping of tape to side wall 16 will be of a part of each of the tape run lengths which extend laterally of the carton top and bottom walls 20, 22. This wiping will be effected with wiping members that move forwardly, and respectively, downwardly and upwardly from the carton top and bottom alongside the carton side wall, engage the laterally extending tape, and press it against fore lengths of the upper and lower perimeter areas of the carton side wall to adhere it to such areas. This result is illustrated in FIGS. 4*a* and 4*b*. In performing this tape wiping action, the tape extending laterally from the carton forward end wall will be folded forwardly parallel to the side wall and an oblique fold as at 44 will be made in that tape adjacent the carton top and bottom walls. This fold 44 will be of adhesive face-to-adhesive face triangular areas of the tape which are defined consequent the wiping action involved.

Figure 5A:
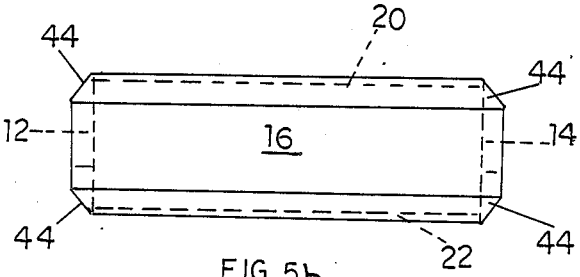
Figure 5B:
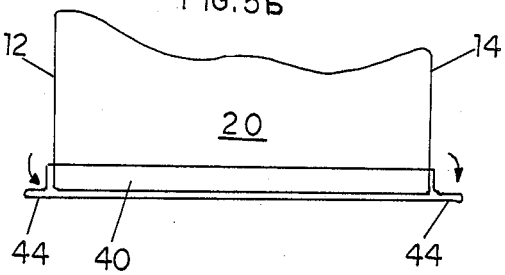

Next, the remaining lengths of the tape extending laterally from the carton top and bottom walls will be wiped against after lengths of the upper and lower perimeter areas of the carton side wall. For such purpose the tape wiping members will be made to move rearwardly and downwardly and upwardly, respectively, from alongside the carton side wall to engage this tape and press it against the carton side wall. FIGS. 5*a* and 5*b* show the result of this wiping action. As with the first wiping, the wiping of the tape against the other lengths of the carton side wall upper and lower perimeter areas will produce a fold of the tape extending laterally from the carton trailing end wall to orient it rearwardly parallel to the carton side wall 16 and it will produce oblique folds 44 thereon adjacent to carton top and bottom walls. An important result of first folding the tape extending from the top and bottom walls against the carton side wall is achievement of full adhesion thereof to and along the full lengths of the upper and lower marginal areas of the carton side wall as well as the formation of clearly defined and neat oblique folds 44.

Figure 6A:
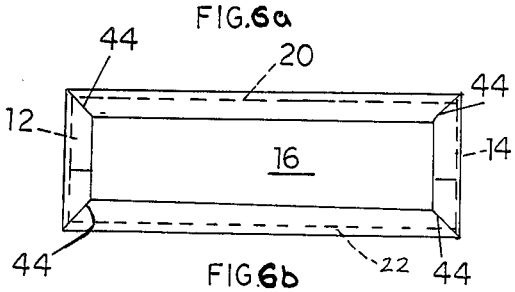
Figure 6B:
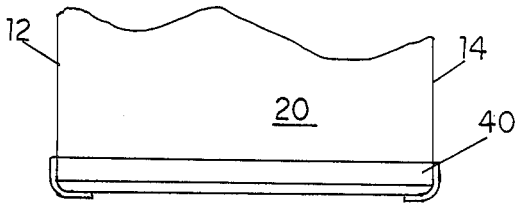

As a final folding, it will be required that the respective forwardly and rearwardly facing tape lengths at the corners defined by the intersection of the carton side wall with the respective forward and trailing end walls be wiped around 180 degrees to adhere them to respective forward and trailing perimeter areas of the carton side wall 16 to produce the completion of the perimeter seal as depicted in FIGS. 6*a* and 6*b*. Important considerations for this final folding and the particular tape folding sequence followed is that no interference with the tape that extended at the top and bottom walls is possible since that tape already has been adhered to the side wall and it results in positioning the oblique folds 44 and more particularly the oblique edge of each fold, to face inwardly on the carton side wall relatively of the carton forward and trailing end walls. This edge positioning reduces the likelihood that accidental tape peel-off initiation could occur if, e.g., a sealed carton is jostled or otherwise moved against another carton during post-taping handling or transportation. If this oblique folding was reversed, i.e., faced outwardly as would result if the tape extending from the forward and trailing end walls was first wiped onto the side wall followed by that extending from the top and bottom walls, such outwardly facing edge of the fold more readily could be disturbed by the sliding of one carton against another and possibly effect undesirable peel-off of the tape.

A machine 50 with which perimeter seals can be applied to a rectangular shipping carton will be discussed now and with particular reference being made to FIGS. 7 and 8. The machine 50 is relatively elongated and has right and left sides R and L thereof as viewed in the machine direction. An upper conveyor belt 52 driving around spaced drums 54, 56 is aligned with a lower belt 58 that is driven around drums 60, 62, the lower straight run length 64 of belt 52, and the upper straight run length 66 of belt 58, respectively, engaging the carton top and bottom walls frictionally sufficiently to positively hold and advance forwardly the carton 10 to be taped, the advance course being along the straight line axis X—X so that during the ensuing taping operation, the carton side walls will move along the advance lines 68R and 68L. Because there are devices which will operate at and contact sides of the carton 10, at locations where taping must occur, normal carton guidance means such as side rails cannot be used in the machine onwards from the point where tape is laterally projecting from the carton and along the machine section where the laterally extending tape is wiped against the side walls. For such reason it is convenient that straight line travel guidance of the carton be achieved by the tight forces applied in opposite directions by the two belts to the carton top and bottom walls, with the belt straight line travel being assured by a V-rib carried on the belt engaging in V-grooves (not shown) formed in drums 54, 56, 60 and 62 with the V-rib also being guided in a V-shaped channel in the machine bed and/or overhead structure. Also and because taping occurs at the carton sides, the belts will drivingly engage the carton top and bottom walls along a central region only of the carton so the side regions thereof are clear for the tape wiping operations.

Arranged at the two sides of the machines are tape applying means provided as tape applying cartridges, the cartridges being paired at each side as an upper cartridge 70 UR or 70 UL with a lower cartridge 72 LR or 72 LL. The cartridges can be arranged so that the upper one will apply tape followed by the lower cartridge applying a tape run to the advancing carton. This arrangement can of course be reversed so that a lower cartridge is first involved in taping and then the upper cartridge. The result of either arrangement is the same. Also the arms of one of the upper or the lower cartridges can be made longer than the other so that the terminal ends of one applied run of tape on the carton perimeter being taped overlap those of the other tape run. In the instance where the machine is used for taping only tall height cartons and no overlap of the two applied runs is to be used so that ample taping arm movement clearance space is available, the upper and lower cartridges can be disposed the one directly above the other.

Figure 7:
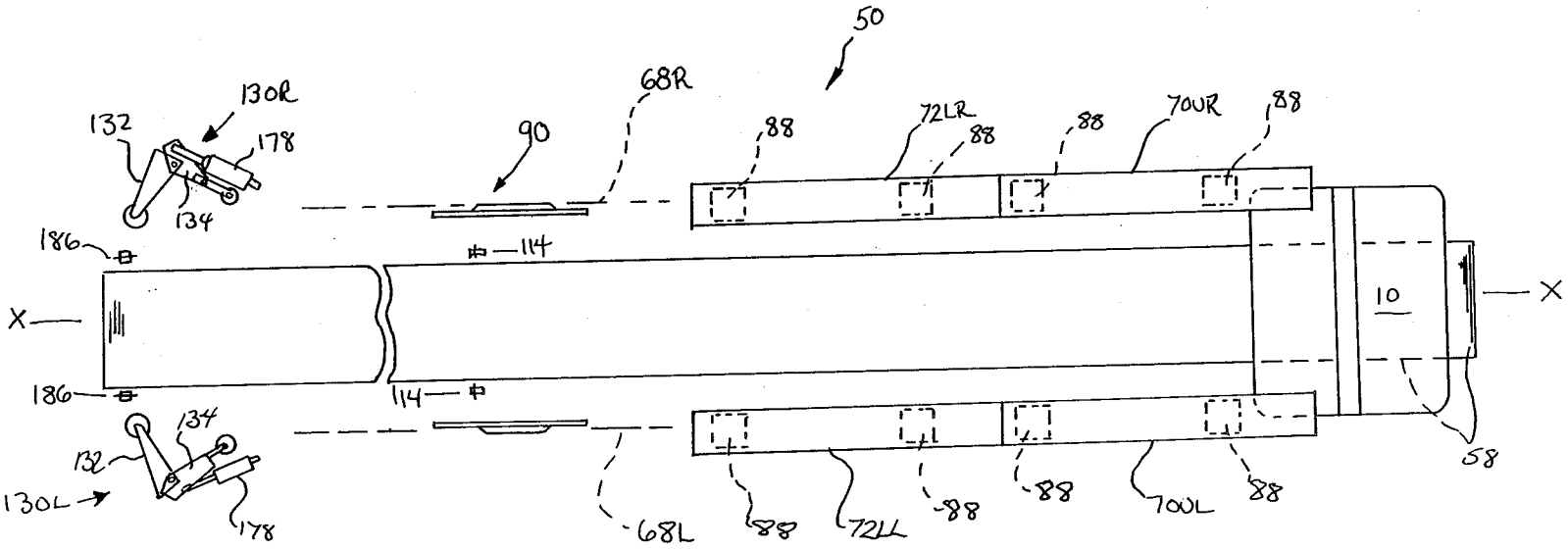
FIG. 7 is a top plan view of a taping machine provided by the invention for applying perimeter seals to a carton, the upper drive belt and tape wiping plate stroking means not being shown in this Figure, and the taping cartridges being depicted in diagrammatic manner only-all for the sake of clarity of showing, such omitted elements being shown in and with detail in FIG. 8.

Each cartridge includes a housing or enclosure 74 in which is carried a pair of tape applying arms 75, 76 normally biased by springs 78 into the projecting positions of each shown in FIG. 7. Each arm 75 presents the adhesive face of a pressure sensitive type tape 80 from a stock 82 positioned in front of a wiping roller 88 on the tip end of arm 75 so the advancing carton will engage that tape for initiating application of a tape run to the carton, the tape run being drawn from the associated stock 82. A tape cutter 84 is provided in each cartridge as is a connecting rod 86 extending between the two arms 75, 76 so that these arms operate in tandem to retract and extend during the tape application operation. The manner by which the tape cartridges operate is disclosed in commonly assigned U.S. Pat. Nos. 4,039,367 and 4,640,731 and the disclosure of said patents is hereby incorporated herein.

Each paired upper cartridge 70 and lower cartridge 72, in the depicted embodiment where tape run overlap is involved, is longitudinally aligned with the other in the pair and such that the taping arms 75 76 operate in taping paths that are laterally coincident, this being evident with reference to FIG. 7 wherein it will be noted that the rollers 88 are aligned. Further, the cartridges are aligned such that the carton side wall advance lines 68R and 68L longitudinally bisect the rollers 88 so that the tape applied to the carton around the side walls will have the first lateral width portion applied to the carton but the other or second lateral width portion will extend beyond the carton side walls and outwardly laterally beyond advance lines 68R and 68L.

Following application of the tape runs 30, 32 around each carton side wall, the carton will pass to and through a tape wiping station shown generally at 90 where the folding of the tape projecting laterally from the carton top and bottom walls will be wiped against the carton side walls to adhere it to said side walls before the tape projecting from the forward and trailing end walls will be wiped against the side wall. At tape wiping station 90 there are supported on each side of the machine, an upper wiping plate 92 paired with a lower wiping plate 94, the paired plates being movably mounted on machine structure 96, 98 (FIG. 10) in manner as will allow the plates to move in wiping travel between forward and rearward nesting positions FIG. 7 shows the right side plates 92R and 94R in rearward nesting position of each. Each wiping plate 92 is rotatably connected as at 99 to corresponding ends of a pair of levers 100, 102, the levers at an opposite end part of each being mounted on pivots 104, one lever 100 having an extension as at 106 which is rotatably connected to the rod 108 of a cylinder unit 110, the cylinder unit being rotatably mounted to a fixed location as at 112.

The cylinder units 110 are fluid operated devices, e.g., double acting air cylinders although other motive means such as electrical solenoids also could be used. In FIG. 8, the cylinders are depicted in the position wherein they hold the wiping plates 92 in rearward nesting position. When the carton 10 passes through the wiping station 90, the air cylinder units 110 will be stroked cyclically, i.e., once forwardly and then rearwardly between the two nesting positions. Movement of the tape wiping plates is more graphically reflected by reference to FIG. 9. In its rearward nesting position (solid lines), the wiping plate 92 is at rest. But when the cylinder unit 110 is operated to stroke the rod 108 thereof rightwardly, lever 100 connected thereto is rotated counterclockwise, and in turn lever 102, to throw the wiping plate forwardly and upwardly (lower plate) and downwardly (upper plate) through an arcuate travel path until the plate reaches its forward nesting position (long and short dashed lines). Since the wiping plate 92 is disposed adjacent the corresponding carton side wall advance line 68R or 68L and in fact when in nesting position slightly inwardly laterally of such advance line, the wiping plate in its movement forwardly will engage the tape extending laterally of the respective carton top or bottom wall and will wipe it against a fore length of the carton side wall upper or lower perimeter area. Maximum carton wiping engagement of the wiping plate 92 with the carton side wall will be when the wiping plate is in the intermediate travel position show in FIG. 9 in dashed lines. With cyclic return movement of the wiping plate from forward to rearward nesting positions, the tape still laterally extending from the carton top and bottom walls at the carton rear half will be wiped against the after length portions of the carton side wall upper and lower perimeter areas. This cyclic movement of the tape wiping plates 92 also will result in the formation of the oblique folds 44 in the tape which was extending laterally from the carton forward and trailing and walls and the orientation of that tape so that it will extend forwardly and rearwardly parallel to the carton side walls as seen in FIG. 5*b*.

The cyclic operation of the tape wiping plates 92, 94 as the carton passes through the wiping station 90 is provided by upper and lower carton engaged control elements 114 which are present at both sides of the machine. When the carton front wall strikes the control elements, these elements are moved to a retracted position and in so retracting communicate air to the appropriate faces of the pistons in the cylinder units to cause stroking of the wiping plates forwardly. After the carton passes beyond the control elements 114 they are released and extend back to the FIG. 8 position wherein they allow communication of pressurized air to the other faces of the pistons to thereby stroke the wiping plates rearwardly.

Figure 9:
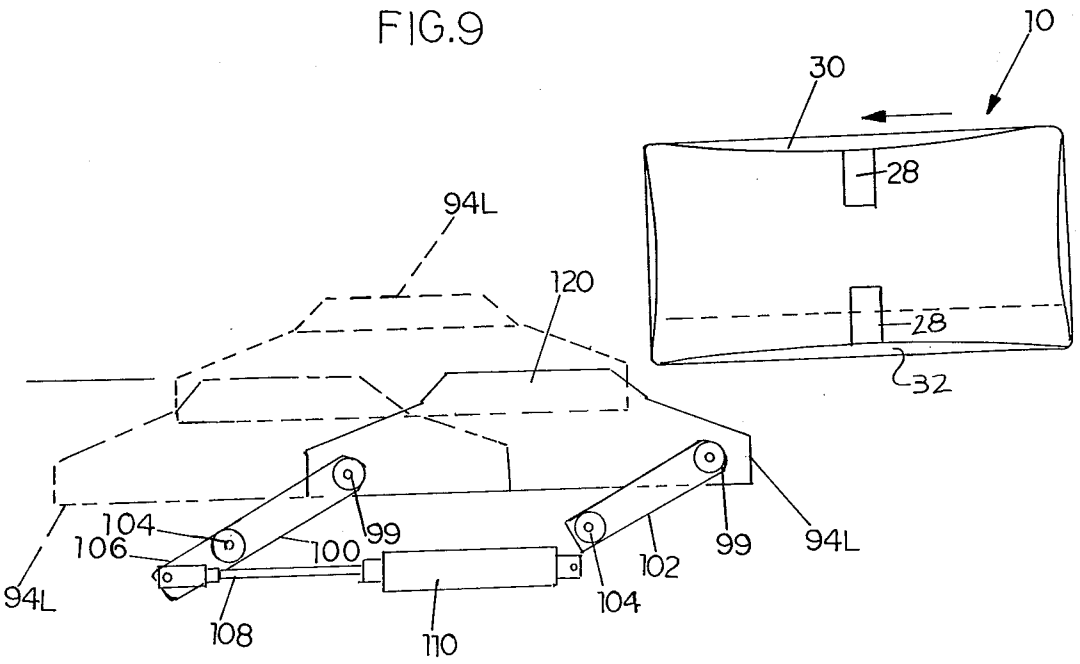
FIG. 9 is a side elevational view of the lower, machine left side tape wiping plate assembly, a carton to which tape has been applied as in FIG. 2 being shown as it approaches the tape wiping station at which said assembly is located, respective rearward and forward nesting positions of the wiping plate being shown respectively, in solid lines and long and short dashed lines, an intermediate position of the taping wiping plate, as when it moves between those nesting positions in wiping contact with the carton sidewall positions being shown in dashed lines.
Figure 10:
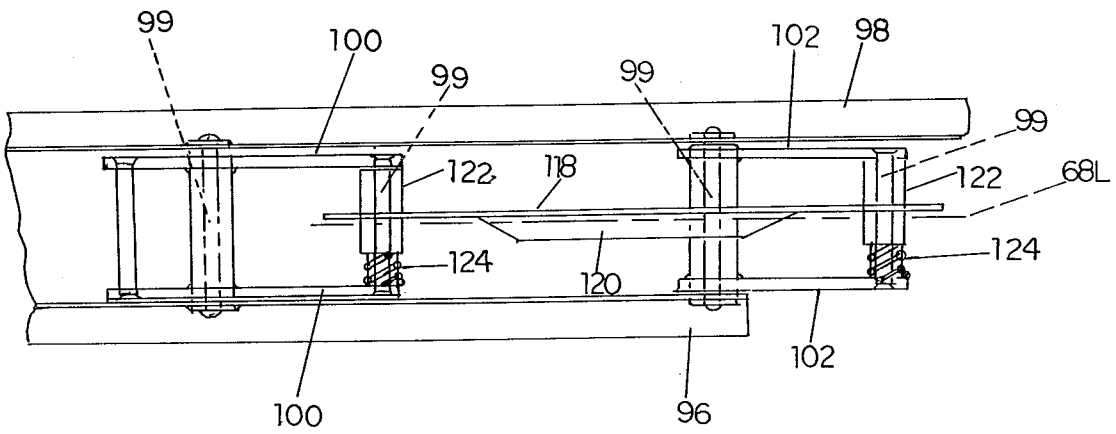
FIG. 10 is a top plan view of a tape wiping plate assembly depicting the manner in which the plate is supported for forward and rearward movements as well as for movement laterally of the carton advance course, the particular assembly which is shown being the lower such assembly at the machine left side.

With reference to FIGS. 9 and 10, it will be understood that when the tape wiping plates 92, 94 are in a nesting position, the carton or tape wiping surfaces 118 thereof are disposed slightly inwardly of the carton side wall advance lines 68R and 68L. The plate 94L shown in FIGS. 9 and 10 is the machine left side lower wiping plate. The plate tape wiping surface 118 of such plate is a flat planar surface and it merges with an outwardly flared portion 120 that extends angularly outwardly across the associated carton side wall advance line. So positioning surface 118 when the plate is in nesting position and using the flared portion 120 to first engage the carton as the plate moves between nesting positions, insures that good wiping contact of the tape against the carton side wall will be achieved since the plate surface 118 will move in contact therewith under an inwardly urged force acting thereon. This is achieved by mounting the wiping plates to be laterally movable against a spring bias force. With reference to the FIGS. 9 and 10 construction, the pivots 99 connecting the plates 94L with levers 100, 102 are surrounded by tube pieces 122 fixed to the plate. It will be noted from FIG. 10 that two laterally spaced apart levers 100 and two spaced-apart levers 102 comprise the plate mounting assembly. Encircling the respective pivots 99 are compression springs 124 engaged with an end face of a tube piece 122 and a side surface of a lever 100, 102. Thus when the wiping plate 94L moves forwardly and upwardly or rearwardly and upwardly between its two nesting positions, the flared portion 120 thereof will engage the lower side corner region of carton 10 and function as a wedge to displace the plate outwardly of the carton side wall advance line 68L so that its flat portion 118 locates exteriorly adjacent the carton side wall and moves smoothly thereagainst but under the inward bias of the springs 124 which become compressed upon the plate moving laterally outwardly. It will be understood that while the wiping members preferably are plates other wiping means such as brushes or rollers also could be used.

Following passage of the carton 10 forwardly of the tape wiping station, it remains to wipe the tape extending from the carton forward and trailing end walls around the corners defined by these walls and the carton side walls and onto the carton side walls. This is done with the tape presser assemblies shown generally at 130R and 130L at the downstream end of the machine. These assemblies 130 will be described next and with continuing reference to FIGS. 7, 8 and 11*a*–11*c*.

Figure 8:
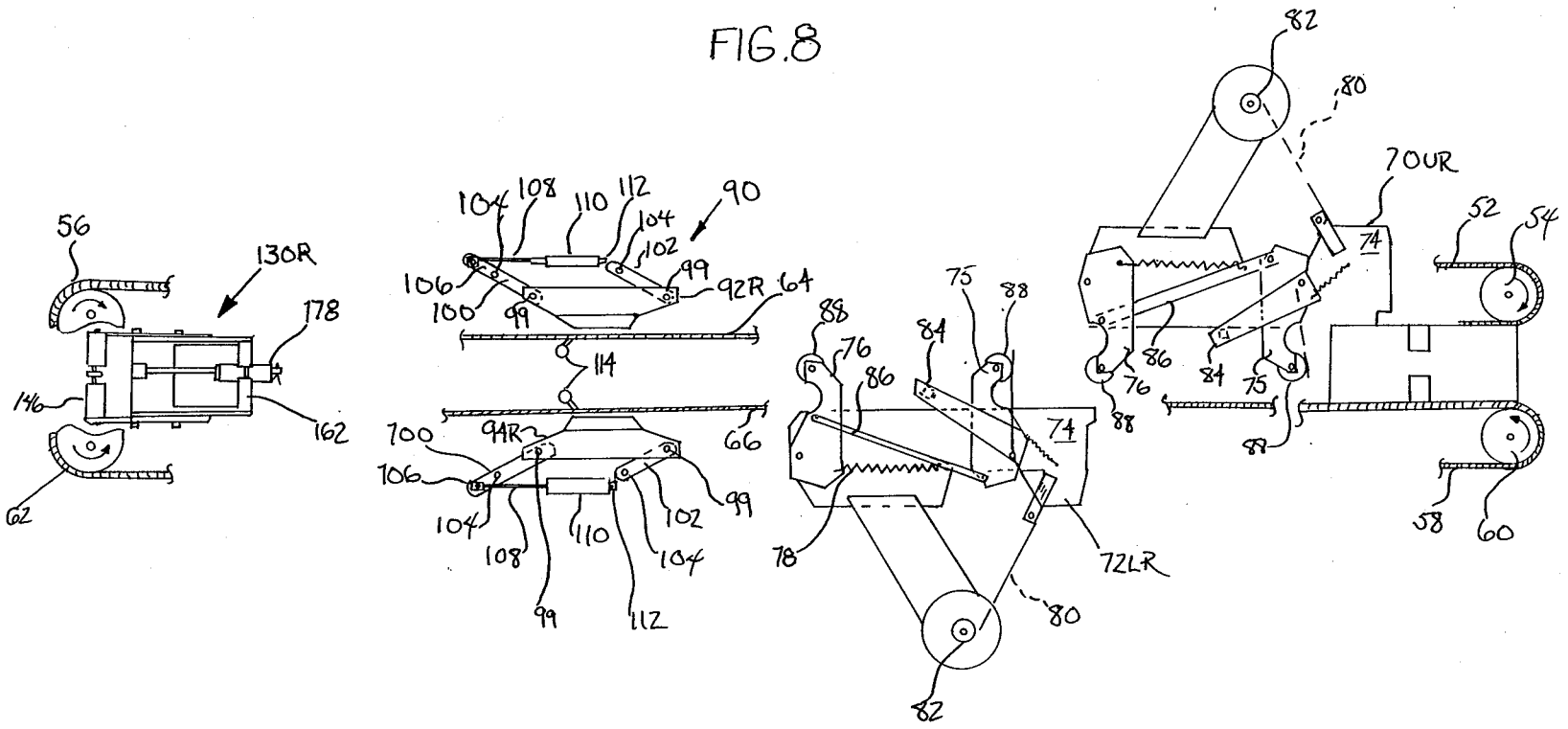
FIG. 8 is a side elevational view of the machine shown in FIG. 7 but depicting only the machine elements disposed along the right side of the belt conveyor, the elements on the left side being identical and identically arranged.
Figure 11A:
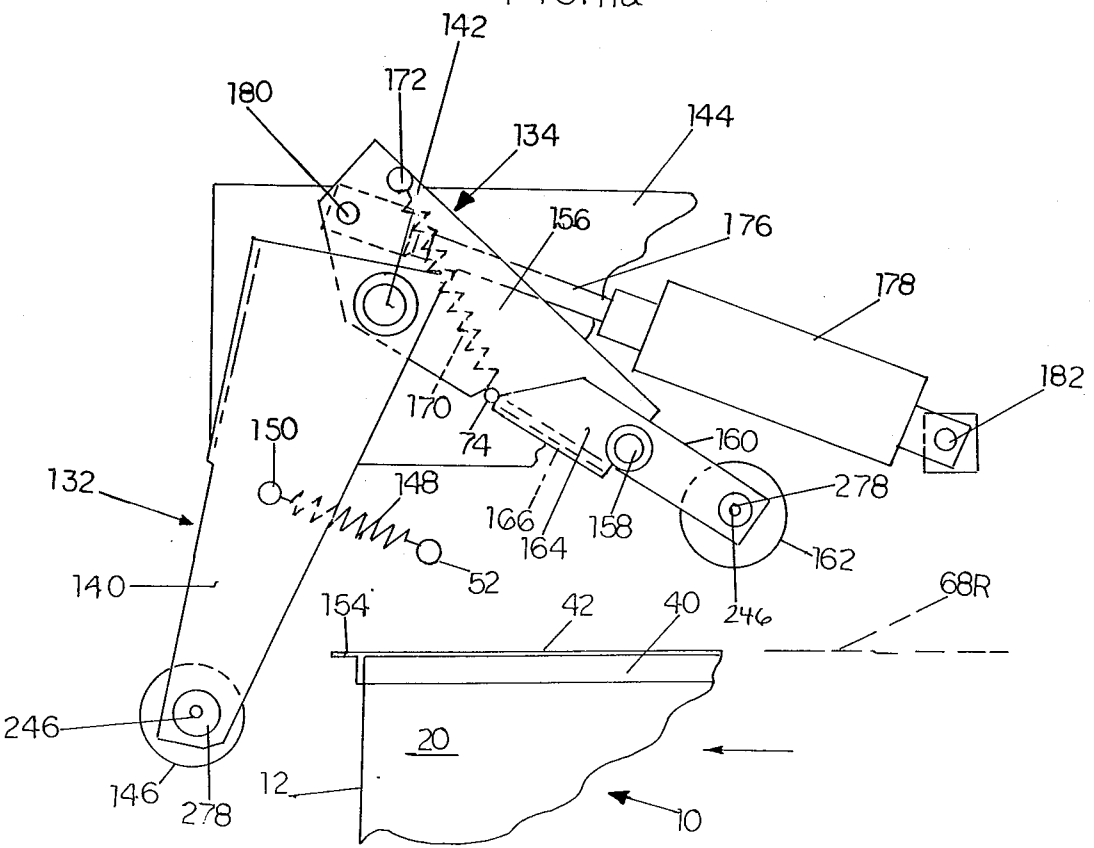
FIGURES 11*a*–11*c* are fragmentary top plan views of the tape presser members employed for wiping tape onto forward and trailing perimeter areas of the carton side wall, the members shown being those on the machine right side, these Figures showing the various positions of the members and the wiping sequence involved in effecting such tape wiping.
Figure 11B:
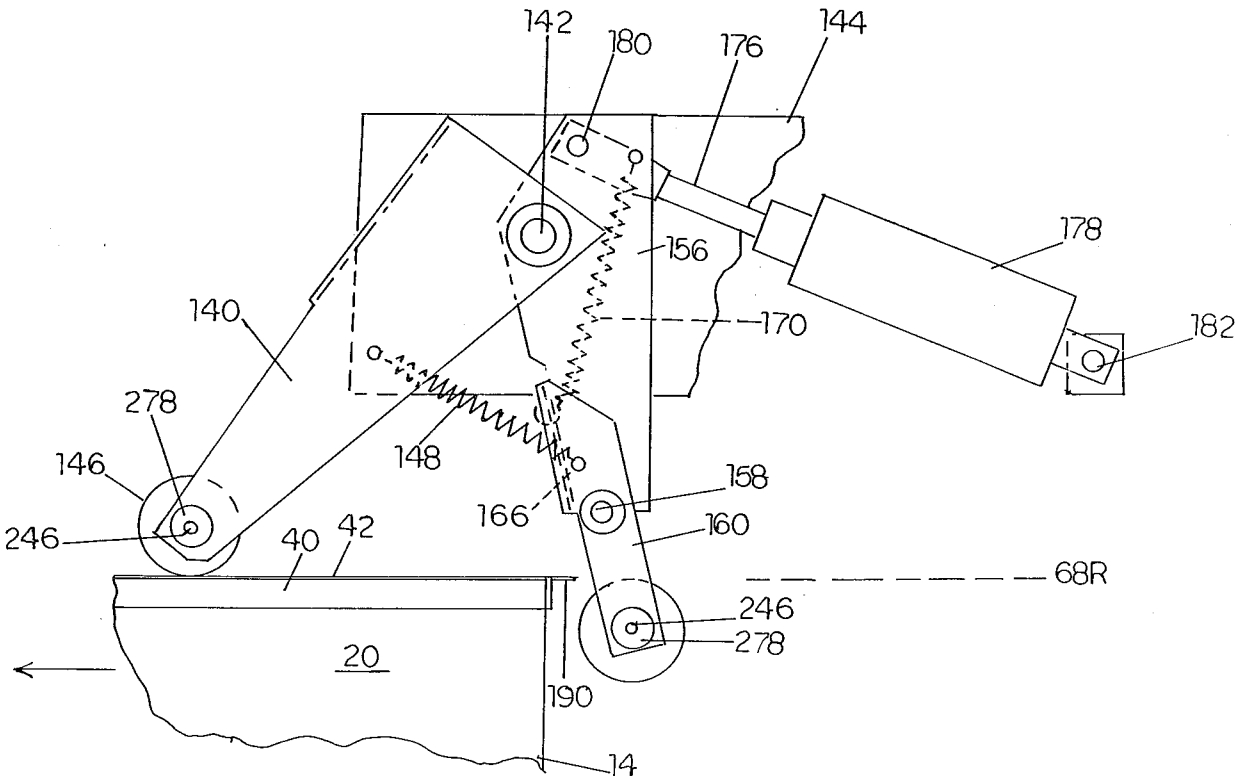
Figure 11C:
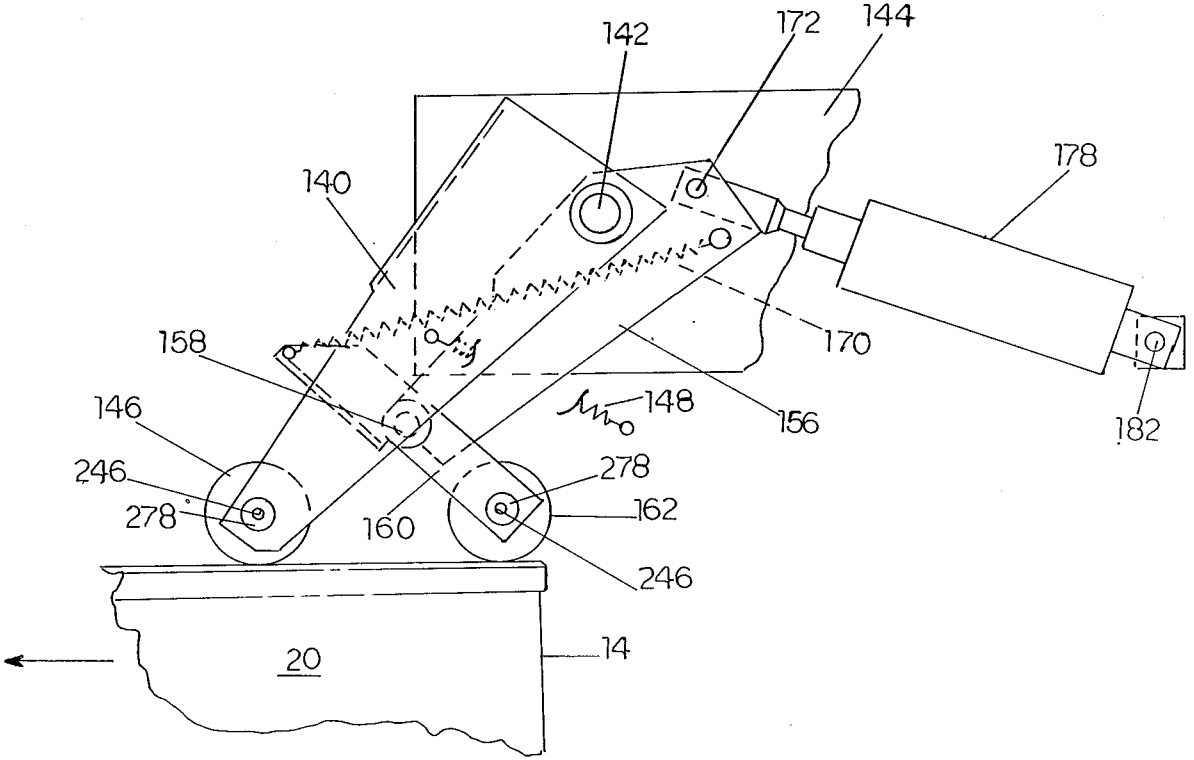

Each assembly 130R, 130L is comprised of two tape presser members, i.e., a tape presser member 132 associated with tape pressing at the forward end of the carton and a tape presser member 134 associated with tape pressing at the trailing end of the carton, these members being shown in their respective non-taping or idle positions in FIGS. 7, 8 and 11*a* and further description is given only in respect of assembly 130R, it being understood that assembly 130L operates the same way. Tape presser member 132 is comprised of a pair of spaced arms 140 which are mounted for pivoting movement at one end as on pivot 142, the pivot being held in machine supporting structure shown generally at 144 in FIGS. 11*a*–11*c*. The other end of the arms 140 carry rotatably thereon, a vertically disposed tape wiping roller member 146 and the arms 140 are connected with a tension spring 148 fixed to the arms as at 150 and to a machine structure location as at 152.

FIG. 11*a* shows the forward end wall 12 of the approaching carton 10 which has had tape wiped on the side walls at wiping station 90 about to engage with the presser member 132 in its idle position and wherein the roller member 146 will engage the carton forward end wall inwardly of the carton side wall advance line 68R proximal the taped marginal area thereon. Following this engagement, the advancing carton will pivot arms 140 clockwise so that roller 146 will move along the carton forward wall outwardly to the edge of the carton and will pass around the corner defined by that wall and the carton side wall 18 to wipe the forwardly extending, parallel-to-the side wall, vertically disposed tape segment 154 onto a forward perimeter area of the carton side wall, the roller 146 now having been moved to a carton advance cleared position (but wherein it remains biased against the side wall) in which it will remain (FIGS. 11*b* and 11*c*) until the carton clears the machine and spring 148 will return the arms to idle position.

For wiping tape in a corner wipe-around operation at the trailing end of the carton, tape presser member 134 will be used. Tape presser member 134 is comprised of a rigid frame section 156 articulated as by pivot 158 with a foldable section 160. The rigid and foldable sections it will be understood include spaced upper and lower support arms, the arms of the rigid frame section conveniently being mounted on the pivot 142 and the arms of the foldable section 160 carrying rotatably a vertically disposed tape wiping roller member 162. The arms of the foldable section 160 gird those of the rigid section 165 as at 164 and a flange stop piece 166 extends between the foldable section plates. A tension spring 170 connects the rigid frame section with the foldable section as at 172,174 and tends to maintain these sections longitudinally aligned in the FIG. 11*a* position; i.e., it tends to rotate the foldable section clockwise and with its stop piece 168 snubbed against the rigid frame.

The rod 176 of a double-acting air cylinder unit 178 is connected to the rigid section 156 as at 180 and the cylinder is pivoted as at 182 on fixed machine structure. Stroking of the cylinder rod will pivot the rigid frame section 156 in the manner as will be described shortly. To effect tape wiping at the carton trailing end wall, it will be necessary to move the tape presser member 134 from the FIG. 11*a* idle position to one wherein the roller member 162 thereof engages the carton trailing end wall 14 inwardly of the carton side wall advance line 68R proximal the taped marginal area thereon. This engagement is shown about to take place in FIG. 11*b*. The movement of the arm is effected by stroking the cylinder unit rod 176 rightwardly and this in turn is brought about by the carton advance having depressed control elements 186 at the machine discharge end. During the pivoting of the tape presser member and until roller member 162 strikes the carton trailing end wall, the rigid and foldable frame sections remain aligned. However, and since the air cylinder unit 178 operates to pivot the rigid frame section at a speed greater than the carton is advancing, the foldable section as soon as member 162 strikes the end wall 14, will start to fold, i.e., pivot relative to the rigid frame section and against the bias of spring 170. The continued stroking of the rigid frame will result in the moving of the roller member 162 outwardly along the carton trailing end wall as the foldable section is folding. The folding action of the foldable section is apparent from FIG. 11*c* and it is such that roller member 162 will pass around the corner defined by carton walls 14 and 18 and wipe the rearwardly extending segment 190 of the tape onto a trailing perimeter area of the carton side wall 14. It will be readily seen that a further wiping of this segment 190 against the trailing perimeter area will be effected by roller member 146 as the carton passes by that member since tape presser member 132 will not return to idle position until after the carton has moved beyond roller member 146.

When the carton 10 has moved forwardly of the roller member 162 engagement therewith, spring 170 will return the foldable section 160 into alignment with the rigid section 156 and the pass by of the carton beyond control element 186 will release that element so that pressurized air will be admitted to an appropriate face side of the piston in the air cylinder unit to stroke rod 176 leftwardly, pivoting the rigid frame section counterclockwise and returning the tape presser member 134 to the idle position of FIG. 11*a*.

Figure 14:
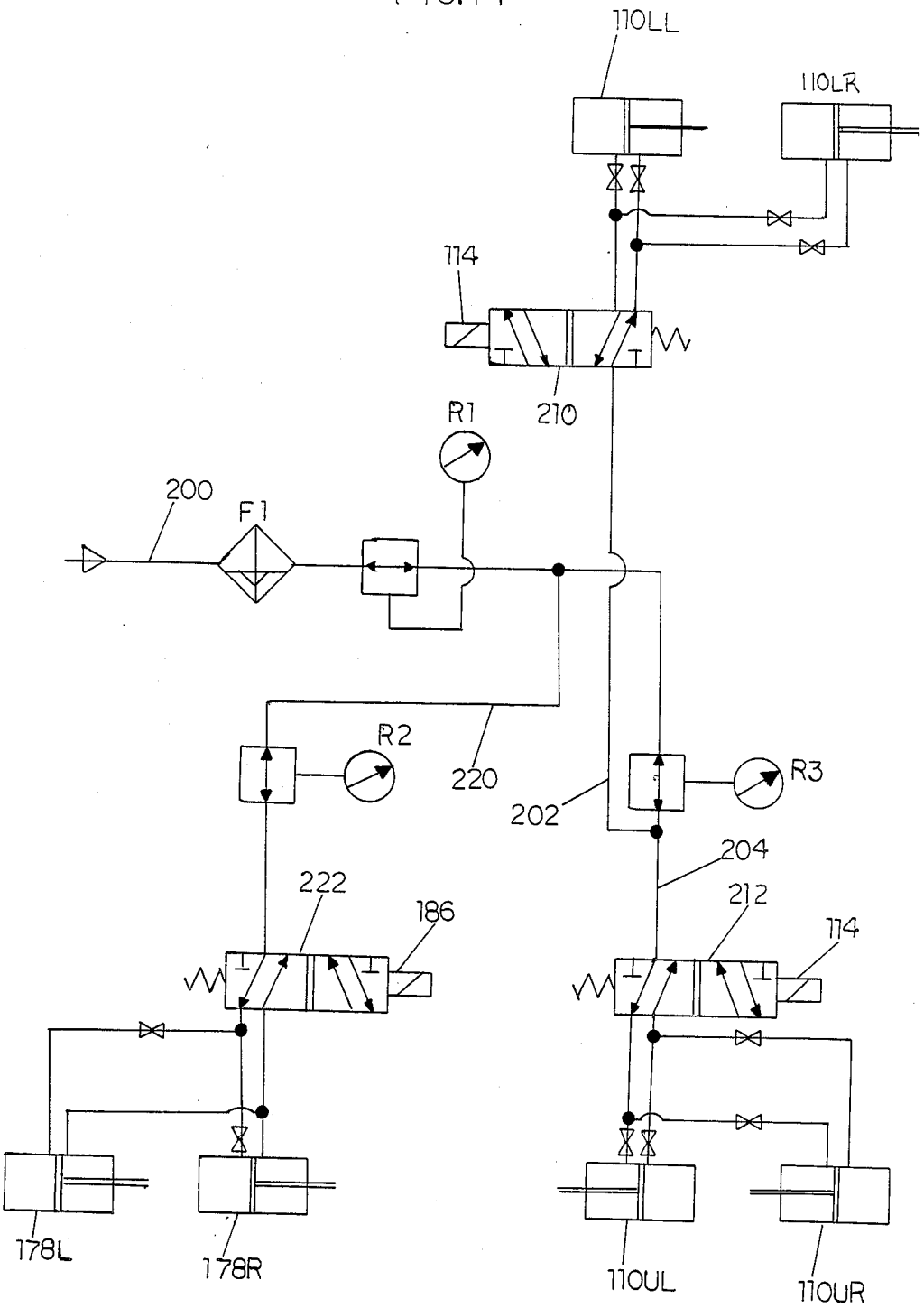
FIG. 14 is a pneumatic circuit diagram showing the arrangement by which power, e.g., a flow of pressurized air, is delivered to the tape wiping plate stroking means and the second tape presser member stroking means.

FIG. 14 shows one manner in which the control of the various power operated cylinder units can be effected. Air under pressure from a suitable source line 200 passes through a filter F1, a regulator R1, another regulator R3 and then flows into two branches 202, 204 leading to the respective lower and upper cylinder units 110 used to control tape wiping plate operation, these branches and cylinders being intervened by the slide valve units 210, 212. It will be seen that the earlier described control elements 114 are part of the slide valve core sliding mechanism and carton depression and release of the elements 114 results in core shifting to communicate pressurized air flow to the piston face sides in the cylinders as required to obtain appropriate forward and rearward stroking of the tape wiping plates. In similar fashion, a third air branch 220 leads through a regulator R2 and is connected with slide valve 222 which communicates with the cylinder units 178L, 178R which operate the tape pressure members 134, the control element 186 shifting the core of the slide valve 222 to obtain forward and return stroking of the cylinder units 178L, 178R.

Figure 12:
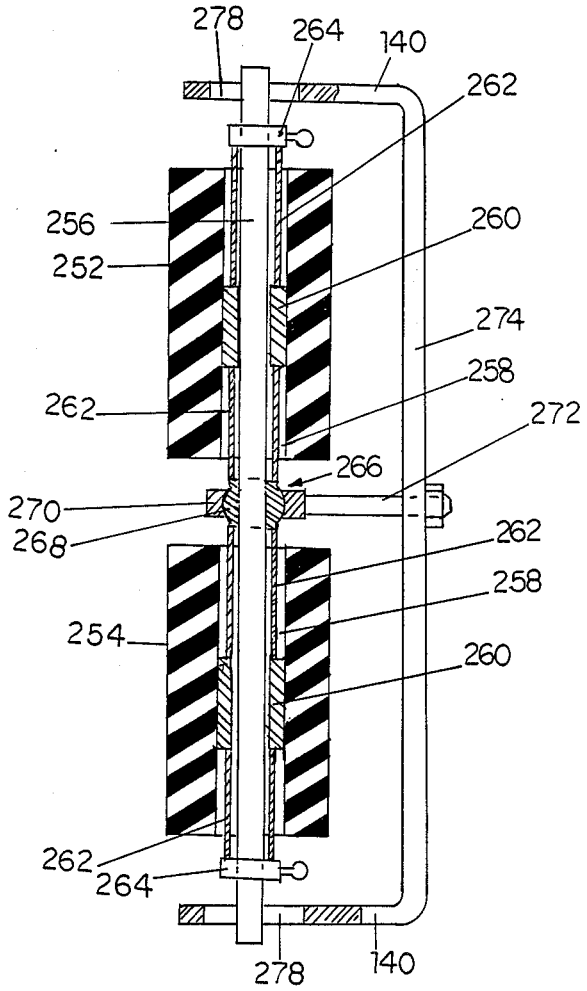
FIG. 12 is an elevational view partly in section showing the construction of roller elements which can be employed as the tape presser members in the FIGS. 11*a*–11*c* tape pressers.
Figure 13:
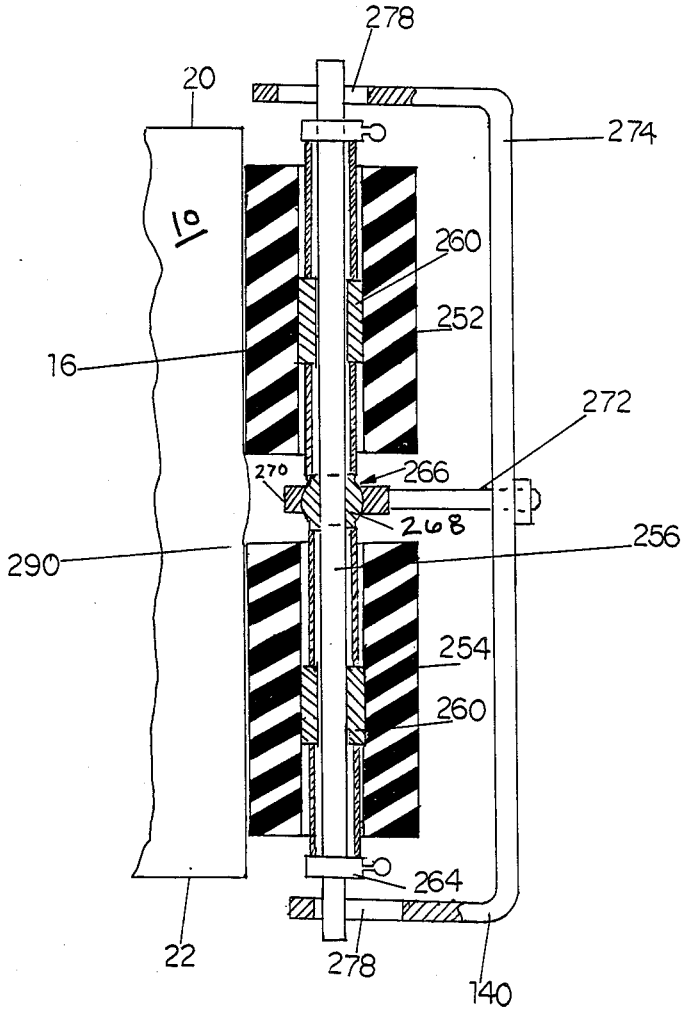
FIG. 13 is an elevational view depicting diagrammatically assembly pivoting and roller deflection features of the FIG. 12 roller element.

FIGS. 12 and 13 depict a particularly advantageous construction of roller assembly which can be employed as the roller members 146, 162 in the tape presser assemblies 130. The roller assembly is comprised of plural, e.g., a pair, of endwise aligned rollers 252, 254 mounted on a common shaft 256 and spaced apart as shown. The rollers which can, e.g., be rubber, each include bore 258 and a bushing 260 is fixed as by adhesive to the bore of the associated roller in the mid-length part of the bore so that a clearance is present between the end sections thereof and the shaft 256. Bushing 260 has an internal diameter somewhat greater than the shaft diameter so that a loose or gapped fit exists therebetween, being, for example, about 20–35 thousands of an inch. A pair of spacers 262 extend between the bushing 260 and a locking ring 264 at one end of each roller, and a spacer extends between the bushing and a universal movement member 266 at the other ends of each roller, the member 266 being located between the two rollers. These spacers hold the respective components axially fixed. The universal movement member 266 includes an inner part 268 encircling the shaft and having a spheroid shape and it is captured in outer or race part 270 which is configured companion to the spheroid part 268, the race part in turn being fixed on a rod 272 to a web 274 extending between, e.g., the arms 140 of the first tape presser member. The extreme ends of the shaft 256 locate in enlarged openings 278 formed in the arms 140. This arrangement allows that the shaft 256, and hence the rollers, have limited universal pivoting movement about race part 270 and relative to the support arms 140 to enable the rollers 252,254 to move in a manner that insures good tape wiping contact of the rollers with irregular or out-of-line carton wall surfaces as will be explained next and with reference to FIG. 13.

While cartons are intended to have orthogonal relationship between the various walls thereof, in practice one wall may dispose at less or more than an orthogonal position with regard to another. If this non-orthogonal relationship is present on walls against which tape is to be wiped, and if wiping is done with a roller member fixed to rotate only about one (vertical) axis, it could result in non-uniform roller contact with the wall and consequently non-uniform tape pressing and adhesion. The FIGS. 12 and 13 roller assembly compensates for irregular carton surface conditions. If as shown in FIG. 13, carton wall 16 is skewed or angled more than 90° relative to the top and bottom walls 20, 22, the roller assembly when engaged therewith will pivot about the universal movement member race part 270 so that the upper roller 252 will engage the more projecting part of the carton wall while the lower roller will move against the lower part of the carton wall, both rollers being urged by the bias force acting on arms 140 into good firm wiping contact with the carton. As was noted earlier, the feature of a gap between bushing 260 in each roller and the shaft 256 allows some independent skewing of one roller on the shaft relative to the other roller so that the skewing roller can accommodate wiping engagement of other carton wall surface irregularities as, e.g., shown at 290 in FIG. 13. If a true orthogonal relationship between carton walls exists, the rollers 252,254 will of course wipe tape in the true vertical disposition of each shown in FIG. 12.

Another advantage of the roller assembly is seen in the fact that axial end segments of the rollers 252, 254 are free, i.e., they are not held by any arm or like support at the roller ends and a space exists between the inner surface of these roller end segment bores and the spacer sleeves. Thus the roller can compress to a greater degree along these end sections than along the central section and this is highly advantageous when the end section of a roller wipes around a carton corner where the corner surfaces tend to be irregular and rounded. A better and more effecting wiping pressure can be applied since the roller can compress in the manner described.

Figure 15:
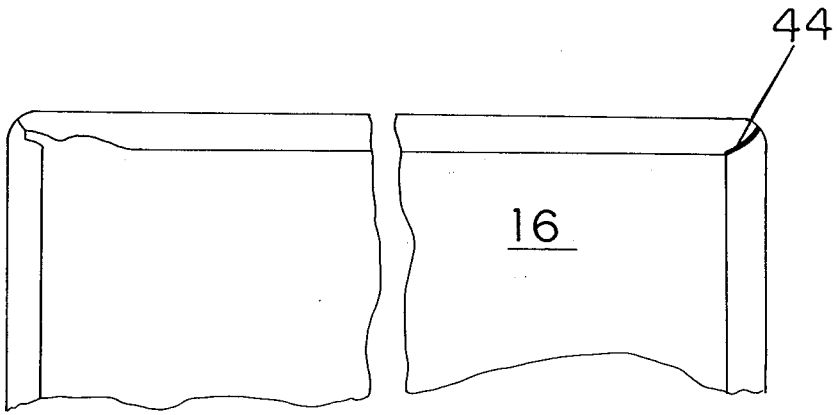
FIG. 15 is a fragmentary elevational view of a carton side wall depicting a comparative showing of the neat taping folding achieved by the invention at one end of the carton, whereas, the other carton end depicts the wrinkled, not fully secured tape folding commonly resulting from use of known taping methods.

FIG. 15 shows an advantage of the present invention as compared to H-seal taping with prior methods and machines. In that Figure, the right upper corner of the carton side wall 16 has been taped per the invention and reflects the neat, clear folding of the top, horizontal and rear trailing vertical tape lengths which have been adhered to the associated perimeter areas of the side wall. The left side on the other hand, shows the messy, not fully adhered result of taping by prior methods which results in severe wrinkling and incomplete adhesion particularly where the oblique fold between the top horizontal and forwardly vertical tape lengths should meet at a smooth oblique angulation.

While there is above disclosed only certain embodiments of the present invention, it will be apparent to these skilled in the art that certain modifications and variations can be made thereto and still remain within the scope of the inventive concept disclosed.

What is claimed is:

1. Machine for applying a wrap around sealing tape course lengthwise of a side wall of a rectangular shipping carton where the side wall has intersection with adjacent and orthogonally disposed carton top, bottom and end walls and such that the tape is adhered to marginal areas of the carton top, bottom and end walls, the tape additionally being adhered to perimeter areas of said carton side wall, the machine comprising carton advance means operable to advance the carton forwardly endwise along a straight line travel course through the machine, upper and lower taping cartridges disposed along the carton travel course and each including carton engaging tape applying members, the upper cartridge being operable such that the tape applying members thereof apply a tape length drawn and severed from a tape stock in said upper cartridge to the carton in a tape run extending from the carton forward end wall onto the carton top wall and down onto the carton trailing end wall, the lower cartridge being operable such that the tape applying members thereof apply a tape length drawn and severed from a tape stock in said lower cartridge to the carton in a tape run extending from the carton forward end wall onto the carton bottom wall and up onto the carton trailing end wall, said upper and lower taping cartridges each being disposed relative to the carton travel course such that a first width portion only of the tape runs applied to the carton is adhered to marginal areas of the carton forward end, top, bottom and trailing end walls and a second width portion of such tape runs extends laterally sideways from each such wall a distance beyond the carton side wall, upper and lower tape wiping members disposed at a tape wiping station downstream of said taping cartridges, said tape wiping members being located alongside the carton travel course adjacent the travel path of the carton side wall and being supported for movement forwardly and rearwardly between two longitudinally spaced nesting positions, the respective tape wiping members when moving forwardly from one to the other nesting position wiping tape extending laterally from the carton top and bottom walls against fore length ends of respective carton side wall upper and lower perimeter areas to adhere it to said areas, the said tape wiping members when moving rearwardly from the said other to the said one nesting position wiping tape extending laterally from the carton top and bottom walls against after length ends of the said carton side wall upper and lower perimeter areas to adhere it to said areas, means operable during carton pass by of the tape wiping station to cyclically stroke said upper and lower tape wiping members forwardly and then rearwardly between the nesting positions thereof, a movably mounted tape presser disposed downstream of the tape wiping station and normally biased to a position wherein it is engaged by the forward end wall of the advancing carton proximal the taped marginal area thereof, the advancing carton moving said tape presser counter to the bias thereon to a carton advance cleared position thereof during which movement said tape presser passes onto said carton side wall and wipes the tape projecting from said carton forward end wall onto a forward perimeter area of said carton side wall to adhere it to said area, a second tape presser disposed downstream of said tape wiping station, said second tape presser being carried on a movably mounted frame member, said frame member having a normally idle position wherein the second tape presser is located outside the carton travel course but adjacent the travel path of the carton side wall, and means connected to said frame member and operable to stroke said frame member from its idle position forwardly from behind the advancing carton to engage the second tape presser against the trailing end wall of the carton proximal the taped marginal area thereof, the frame member including a rigid section and a foldable section thereon, the second tape presser being carried on said foldable section, the frame stroking means stroking the frame member forwardly at a greater speed than that at which the carton is being advanced whereby upon engagement of the second tape presser with the carton trailing end wall, the frame foldable section is caused to fold relative to the forwardly moving rigid section thereby passing the second tape presser from the carton trailing end wall onto the carton side wall, said second tape presser during such passage wiping the tape projecting from said carton trailing end wall onto a trailing perimeter area of said carton side wall to adhere it to said area.

2. The machine in accordance with claim 1 in which said carton advance means comprises at least one transport belt which traverses an endless belt travel course, the carton being received on and transported forwardly by an upper forwardly travelling belt straight run course.

3. Machine in accordance with claim 2 further comprising a second transport belt disposed above said one transport belt, said second transport belt having a carton engaging forwardly travelling lower belt straight run course.

4. The machine in accordance with claim 3 in which the upper forwardly travelling straight run course of said first belt and the carton engaging straight run course of said second transport belt are vertically spaced such as to engage tightly frictionally, respectively, with the carton bottom and top walls.

5. The machine in accordance with claim 4 in which the widthwise dimension of said one and 'said second transport belts are such that only central longitudinal portions of the respective bottom and top walls of the carton are engaged by said belts during the course of carton transport through the machine.

6. The machine in accordance with claim 1 in which the upper and lower taping cartridges are spaced longitudinally one from the other along the carton travel course so that the tape run applied to the carton by one is applied to the carton followed by application of a tape run to the carton by the other cartridge.

7. The machine in accordance with claim 1 in which the upper and lower taping cartridges are aligned one with the other in the carton travel course direction so that the taping members of each operate in taping paths which are longitudinally aligned and laterally coincident.

8. The machine in accordance with claim 7 in which the upper and lower taping cartridges are longitudinally spaced one from the other and are vertically spaced such that tape applied by the tape applying members of one overlap that applied by the tape applying member of the other on the forward and trailing end walls of the carton.

9. The machine in accordance with claim 6 in which the upper and lower taping cartridges are vertically spaced one from the other, the tape applying members of each comprising tape applying arms, the tape applying arms of one cartridge being longer than the arms of the other so that tape applied with the arms of the said one cartridge has overlapped relationship on the carton forward and trailing end wall with the tape applied with the arms of the other cartridge.

10. The machine in accordance with claim 1 in which the upper and lower tape wiping members each comprise an elongated plate having a generally flat vertically disposed carton engaging wiping face portion.

11. The machine in accordance with claim 10 in which the upper and lower tape wiping plates are each supported for movement between the two nesting positions along a generally arcuate movement path.

12. The machine in accordance with claim 11 in which the support for each tape wiping plate includes a pair of levers, each lever in the pair being mounted on a pivot at one end thereof, the other end of each such lever in the pair being rotatably mounted to the plate adjacent one of the ends of said plate.

13. The machine in accordance with claim 12 in which the means for cyclically stroking said upper and lower tape wiping plates is a separate stroking means for each, each said separate stroking means being connected to one of the support levers of the associated pair.

14. The machine in accordance with claim 13 in which each separate stroking means comprises a double-acting power operated component operable to transmit force in each of two opposite directions.

15. The machine n accordance with claim 14 in which said power operated component is a double-acting cylinder unit, said unit having a moveable rod connected to the said one support lever of the associated lever pair.

16. The machine in accordance with claim 1 in which the means for cyclically stroking said upper and lower tape wiping members comprises a separate double-acting power operated component associated with each tape wiping member and connected therewith, and a carton advance actuatable control member operating during carton pass by of the tape wiping station to apply power to the power operated component such as to move it in one direction and thereby stroke the associated tape wiping member forwardly from one to the other nesting position and then to apply power to the power operated component such as to move it in an opposite direction thereby to stroke the associated tape wiping member rearwardly from the said other to the said one nesting position.

17. The machine in accordance with claim 16 in which the control member is a switch normally extended into the carton travel course and in such extended position operating to maintain power communication to the power operated component which moves it in the tape wiping member rearwardly stroking direction, the advancing carton during pass by of the wiping station engaging said switch and moving it to a retracted position in which position it operates to establish communication of power to the power operated component which moves it in a tape wiping member forwardly stroking direction, forward travel of the carton beyond the switch releasing the switch so it can return to extended position and thereby communicate power to the power operated component which moves such component in the tape wiping member rearwardly stroking direction.

18. The machine in accordance with claim 17 in which said power operated component is a double acting, fluid operated cylinder unit including a piston movable within a cylinder, the switch being operable in its respective extended and retracted positions to communicate fluid under pressure to respective opposite forces of said piston.

19. The machine in accordance with claim 10 in which each of the upper and lower tape wiping plates is carried on an associated mounting assembly, the mounting assembly being movable laterally of the carton travel course, bias means normally urging said mounting assembly in a direction such that the flat wiping face of the tape wiping plate when the plate is in a nesting position is disposed slight inwardly of the carton side wall travel path whereby when said tape wiping plate moves between its nesting positions to engage the carton side wall in tape wiping contact therewith, the mounting assembly will move counter to the bias to accommodate the corresponding laterally outward displacement effected to the tape wiping plate to bring it into tape wiping engagement with the carton side wall.

20. The machine in accordance with claim 19 in which each tape wiping plate includes a flared portion adjacent the flat wiping face portion and arranged such that during tape wiping plate movement between nesting positions, the flared portion engages the carton as a displacement wedge thereby moving the flat face portion laterally outwardly to carton side wall engagement position thereof.

21. The machine in accordance with claim 1 in which the first tape presser is carried in a pivotable arm, the arm being engaged with a bias means to normally bias hold said arm in a first arm position wherein it positions the tape presser for engagement thereof by the forward end wall of the advancing carton, the pivotable arm being pivoted counter to the bias means in a forward direction by the advancing carton to move it to a second position at the side of the advancing carton wherein it positions the first tape presser in the carton advance cleared position thereof with the bias means acting to urge said first tape presser against the carton side wall.

22. The machine in accordance with claim 21 in which the first tape presser is disposed such as to present a vertically oriented tape wiping surface.

23. The machine in accordance with claim 22 in which the first tape presser has a wiping surface height substantially equal to the height of the carton being taped.

24. The machine in accordance with claim 21 in which the arm biasing means is a tension spring.

25. The machine in accordance with claim 21 in which the first tape presser is a vertically disposed tape wiping roller element rotatably mounted on said pivotable arm.

26. The machine in accordance with claim 1 in which the second tape presser mounting frame rigid section is mounted on a pivot, the foldable section of the mounting frame being pivoted to the rigid section, the frame rigid and foldable sections each being elongated structures, a bias applying member connected with said rigid section and with said foldable section and acting normally to maintain said rigid and foldable sections longitudinally aligned, the foldable frame section when folded relative to the forwardly moving rigid section incident the engagement of the second tape presser against the trailing end wall of the carton upon the frame member having been stroked forwardly, pivoting in a direction counter to the force applied thereto by said bias applying member whereby upon forward travel of the carton beyond the second tape presser, the bias applying member restores said foldable section to longitudinally aligned positioning with the rigid section member.

27. The machine in accordance with claim 26 in which the bias applying member is a tension spring.

28. The machine in accordance with claim 26 in which the second tape presser mounting frame stroking means is connected with the rigid section of said frame.

29. The machine in accordance with claim 26 in which the second tape presser is a vertically disposed tape wiping roller element rotatably mounted on the foldable section of the frame member.

30. The machine in accordance with claim 26 in which the second tape presser mounting frame stroking means is a fluid operated cylinder unit including a piston movable within a cylinder, the piston being connected to one end of a rod, the other end of the rod being connected to the rigid section of the frame member, admission of fluid under pressure to one face of said piston moving said rod to pivot said frame member forwardly from idle position.

31. The machine in accordance with claim 30 in which the fluid operated cylinder unit is a double acting unit, the machine including a carton advance actuatable control member disposed in the path of the advancing carton, engagement of the advancing carton forward end wall with said control element movably orienting said control element from an initial position thereof to one wherein it controls admission of fluid pressure to one face of the piston to move it in a direction for stroking the second tape presser frame forwardly from idle position, forward travel of the advancing carton beyond said control element releasing it to return to initial position wherein it controls admission of fluid pressure to the other face of the piston for moving it in a direction which strokes the said frame to idle position.

32. The machine in accordance with claim 25 in which the tape roller element is comprised of at least two axially spaced rollers mounted rotatably on a common shaft, a universal movement member connected with said shaft intermediate the roller members and being fixed to said pivotable arm to define a normal shaft tape wiping disposition, said universal movement member including an outer race part and an inner part encircling the common shaft, the outer race part and the inner part having companion spheroid surfaces whereby the common shaft is capable of limited universal pivoting movement from its normal disposition to thereby bring each of the roller members into full tape wiping contact with a carton surface disposed skewed to the normal shaft disposition.

33. The machine in accordance with claim 32 in which the rollers are loosely mounted on said common shaft sufficiently to skew relative to the shaft to a limited extent so that the rollers can during tape wiping engagably conform with carton surface irregularities.

34. The machine in accordance with claim 29 in which the tape roller element is comprised of at least two axially spaced rollers mounted rotatably on a common shaft, a universal movement member connected with said shaft intermediate the roller members and being fixed to said frame foldable section to define a normal shaft tape wiping disposition, said universal movement member including an outer race part and an inner part encircling the common shaft, the outer race part and the inner part having companion spheroid surfaces whereby the common shaft is capable of limited universal pivoting movement from its normal disposition to thereby bring each of the roller members into full tape wiping contact with a carton surface disposed skewed to the normal shaft disposition.

35. The machine in accordance with claim 34 in which the rollers are loosely mounted on said common shaft sufficiently to skew relative to the shaft to a limited extent so that the rollers can during tape wiping engagably conform with carton surface irregularities.

* * * * *